US005287823A

United States Patent [19]

Jiang

[11] Patent Number: 5,287,823

[45] Date of Patent: Feb. 22, 1994

[54] REMOVABLE PAGE MARKER

[75] Inventor: Curtis T. Jiang, San Francisco, Calif.

[73] Assignee: QLH USA, Inc., San Francisco, Calif.

[21] Appl. No.: 17,748

[22] Filed: Feb. 16, 1993

[51] Int. Cl.[5] ..... B42D 9/00

[52] U.S. Cl. ..... 116/237; 116/234

[58] Field of Search ..... 116/234, 235, 236, 237, 116/238, 239, 240; 40/641; 281/42

[56] References Cited

U.S. PATENT DOCUMENTS

| | | | |
|---|---|---|---|
| 1,123,008 | 12/1914 | Rice | 116/237 |
| 2,415,248 | 2/1947 | Kenna et al. | 40/641 |
| 2,448,611 | 9/1948 | Martin | 116/234 |
| 3,697,100 | 10/1972 | Hawkins | 281/42 |
| 3,744,447 | 7/1973 | Hernon | 116/239 |
| 4,024,832 | 5/1977 | Machnikowski | 116/237 |
| 4,162,659 | 7/1979 | Burke | 116/234 |
| 4,462,614 | 7/1984 | Krause | 281/42 |
| 4,732,107 | 3/1988 | Jacobsen | 116/237 |
| 5,103,756 | 4/1992 | Korkames | 116/234 |
| 5,103,758 | 4/1992 | Clark | 116/237 |

FOREIGN PATENT DOCUMENTS

| | | | |
|---|---|---|---|
| 3543402 | 5/1986 | Fed. Rep. of Germany | 116/234 |
| 2195291 | 4/1988 | United Kingdom | 116/234 |

*Primary Examiner*—William A. Cuchlinski, Jr.
*Assistant Examiner*—W. Morris Worth

[57] ABSTRACT

An improved page marker for positionable and removable attachment to a sheet comprising two panels and one extending area. The panels, which may be in an extended or unfolded position or may be folded back against each other along a common bend or crease, are used in conjunction with a conventional paper clip to secure a sheet. Both panels consist of retainer means to keep the paper clip in position when the page marker is being moved by force. The area extending beyond the two panels and the clipped sheet serves the purpose as a marking or message means for a book, a filing system, or the like papers.

4 Claims, 1 Drawing Sheet

REMOVABLE PAGE MARKER

DESCRIPTION

This invention relates to a positionable and removable page marker adapted to be attached in conjunction with a paper clip to a sheet in a book or a filing system to convey a message and/or locate a specific position therein.

BACKGROUND OF THE INVENTION

Page markers which commonly are used to mark a page in a book include paper, metal or plastic clips, post-it tabs, stickers, clamps, or ribbons. However, these markers have certain drawbacks; they are not capable of adhering firmly on a page, being slid to a desired position, being easily removed and reused, providing a write-on space, or being manufactured economically.

SUMMARY OF THE INVENTION

The present invention provides an improved removable page marker with all of the above stated advantages. It is the general purpose of the present invention to provide such a page marker:

which is simple in construction, of low cost, and effective in achieving its designed purpose;

which is used to mark a selected position of a sheet in a book a file, or the like papers;

which provides a write-on message area;

which can easily be engaged with a conventional paper clip to fasten to a sheet;

which can be adjustably slid on edge of, easily removed from, or firmly attached to a sheet;

which can retain the engaged paper clip in position when being moved by force;

which will not damage the item it is attached to.

DESCRIPTION OF THE PREFERRED EMBODIMENTS

Figure 1:
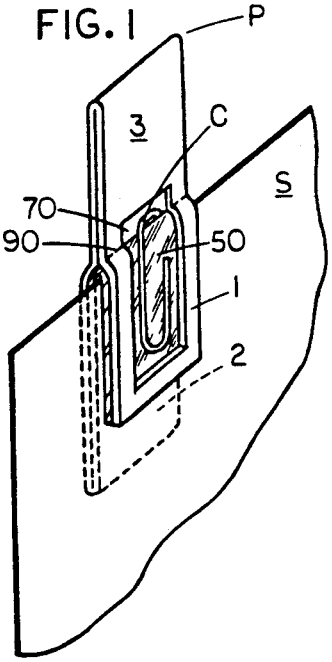
FIG. 1 is a perspective view of the invention attached to a sheet by a paper clip.

Referring to FIG. 1 of the drawings, a page marker P, engaged with a conventional paper clip C, is attached to a sheet S. The page marker P, formed from a single, or multiple sheets of elongated rectangular paper, card stock, or plastic material, has a front panel 1, a back panel 2, and an extending area 3.

Figure 2:
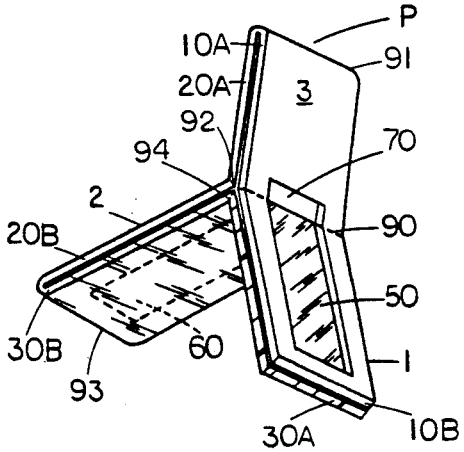
FIG. 2 is a partially exploded plan view of the invention.
Figure 3:
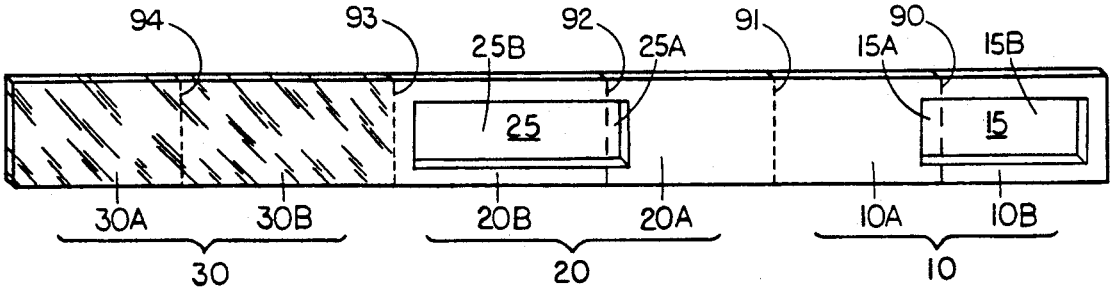
FIG. 3 is a completely exploded plan view of the embodiment of the invention.

The construction of the page marker P is particularly apparent from FIG. 2 and FIG. 3.

As shown in these figures, the marker P comprises three elongated rectangular sections: 10, 20, and 30 which may be part of an one-piece sheet folded at lines 91, 93 and 94, or which may be formed from multiple sheets separated at lines 91 and 93.

There is one rectangular aperture on each of the section 10 and 20. Lines 90 and 92 divide section 10 and its aperture 15, and section 20 and its aperture 25, respectively, into upper and bottom portions: 10A, 10B, 15A, 15B, 20A, 20B, 25A, and 25B. Line 94 divides section 30 into two portions: 30A and 30B.

Portions 30A and 10B are of the same length and are adhesively secured together to form a front panel 1, as are portions 30B and 20B to form a back panel 2. Both panels, which may be in an extended or unfolded position or may be folded back against each other along their common bend 94, are used to slip on or sandwich a sheet.

An aperture 70, formed from the combination of portions 15A and 25A, is used as an entrance for a conventional paper clip to fasten the marker P to a sheet by securing the sheet between the two panels 1 and 2.

An extending area 3, formed by permanent adhesion between two portions 10A and 20A, connects to panels 1 and 2 along two common bends 90 and 92. Area 3, which is relatively flexible and is able to bend or yield along these two bends, will prevent the attached sheet S from damage should a book containing the page marker P be dropped. The visibility of the extending area 3 above the panels and the sheet serves the purpose of marking and message means.

An U-shaped slot 50 is formed from the combination of one side of portion 30A and the unshaped inner walls of the aperture 15B; similarly, another slot 60 is formed from portion 30B and aperture 25B. These slots serve to retain the paper clip in position when the page marker is being moved. Each of the lengths of portions 10B, 15B and 30A is shorter than each of the lengths of portions 20B, 25B, and 30B. These lengths are designed to fit the different lengths of two clipping members of a conventional paper clip.

As seen in the figures, the main advantage of this invention is that the page marker is designed to be economically manufactured, to be used in conjunction with a paper clip which is a very common item in an office or a home, to be slid on, firmly attached to, or easily removed from a sheet, and to have a write-on message area. Thus the invention serves the purpose of providing a simple, low-cost, and effective marking and message means which can be placed in a book, a file, or the like papers.

It is to be understood that the invention is not limited to the embodiment described above. For example, the sizes, shapes and thickness of the extending area, the panels, the aperture, and the paper clip retainers can vary. Other embodiments are within the spirit and the scope of the invention, and fall within the scope of the claims.

What is claimed is:

1. A removable page marker comprising:

a front panel, a back panel and a lower panel wherein said front and back panels each have an elongated slot therethrough;

a top edge of said front and back panels being aligned;

a top end of each slot of said front and back panels being aligned;

said front and back panels being contiguous from said top edges to a diverging point below said top end of the elongated slot of said front and back panels;

said lower panel being contiguous with said front panel from a lower edge of said front panel to said diverging point and thereafter being contiguous with said back panel to a lower edge of said back panel;

said lower, front and back panels and respective slots below said diverging point forming means for retaining clipping members of a paper clip;

said top end of said slots forming aperture means for entrance of said paper clip whereby one clipping member of said clip is received in the retaining means associated with the front panel and a second slipping member of said clip is received in the retaining means associated with the back panel.

2. The removable page marker of claim 1 wherein said front, back and lower panels are integrally formed.

3. The removable page marker of claim 1 wherein contiguous portions of said front, back and lower panels are adhesively secured together.

4. The removable page marker of claim 1 wherein contiguous portions of said front and back panels form means for marking a page and for receiving a message.

* * * * *